US009528482B2

(12) United States Patent
Abe et al.

(10) Patent No.: US 9,528,482 B2
(45) Date of Patent: Dec. 27, 2016

(54) ELECTROMAGNETIC FUEL INJECTION VALVE

(71) Applicant: Hitachi Automotive Systems, Ltd., Hitachinaka-shi, Ibaraki (JP)

(72) Inventors: Motoyuki Abe, Tokyo (JP); Ryo Kusakabe, Tokyo (JP); Hideharu Ehara, Hitachinaka (JP); Yoshihito Yasukawa, Tokyo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/416,693

(22) PCT Filed: Jun. 19, 2013

(86) PCT No.: PCT/JP2013/066779
§ 371 (c)(1),
(2) Date: Jan. 23, 2015

(87) PCT Pub. No.: WO2014/017227
PCT Pub. Date: Jan. 30, 2014

(65) Prior Publication Data

US 2015/0267665 A1 Sep. 24, 2015

(30) Foreign Application Priority Data

Jul. 27, 2012 (JP) ..... 2012-166480

(51) Int. Cl.
*F02M 51/06* (2006.01)
*F02M 61/12* (2006.01)

(52) U.S. Cl.
CPC ..... *F02M 51/0675* (2013.01); *F02M 51/0685* (2013.01); *F02M 61/12* (2013.01)

(58) Field of Classification Search
CPC ..... F02M 51/00; F02M 61/10; B05B 1/30; Y10S 239/90
(Continued)

(56) References Cited

U.S. PATENT DOCUMENTS 6,510,841 B1 1/2003 Stier
2004/0050977 A1 * 3/2004 Rieger ..... F02M 51/0685 239/585.1
(Continued)

FOREIGN PATENT DOCUMENTS

DK EP2444651 * 4/2012 ..... F02M 51/06
JP 2003-511604 A 3/2003
(Continued)

OTHER PUBLICATIONS

International Search Report (PCT/ISA/210) dated Jul. 23, 2013, with English translation (two (2) pages).

*Primary Examiner* — Arthur O Hall
*Assistant Examiner* — Christopher R Dandridge
(74) *Attorney, Agent, or Firm* — Crowell & Moring LLP

(57) ABSTRACT

Provided is an electromagnetic fuel injection valve in which in both operations of opening and closing a valve, a movable element is made to free run before a valve element starts to operate, and bounding motion of the movable element occurring at the time of the valve opening operation is reduced, thereby balancing improvement of responsiveness and improvement of stability of operation. There are equipped with: a first movable element 105, which is biased by a first spring 106 biasing in a valve closing direction, as a movable element which opens and closes a valve when being attracted by a magnetic core 109 of the electromagnetic fuel injection valve; and a second movable element 104 biased toward the magnetic core 109 by a second spring 112 biasing in a valve opening direction.

13 Claims, 3 Drawing Sheets

(58) Field of Classification Search
USPC ..... 239/533.2–533.12, 585.1–585.5, 584
See application file for complete search history.

(56) References Cited

U.S. PATENT DOCUMENTS

| | | | | |
|---|---|---|---|---|
| 2012/0080542 | A1* | 4/2012 | Imai | F02M 51/0671<br>239/533.2 |
| 2013/0221138 | A1* | 8/2013 | Rogler | F02M 51/06<br>239/585.5 |

FOREIGN PATENT DOCUMENTS

| | | | |
|---|---|---|---|
| JP | 4603749 | B2 | 12/2010 |
| JP | 2012-97728 | A | 5/2012 |

* cited by examiner

ELECTROMAGNETIC FUEL INJECTION VALVE

TECHNICAL FIELD

The present invention relates to an electromagnetic fuel injection valve which is used in an internal combustion engine and is opened and closed by electromagnetic force. In particular, the present invention relates to an electromagnetic fuel injection valve preferably used for a spark ignition type internal combustion engine (gasoline engine) which uses, as an internal combustion engine, gasoline or the like as fuel.

BACKGROUND ART

In a commonly-used electromagnetic fuel injection valve, an open valve state and a closed valve state are switched by presence or absence of energization, and period of the open valve state is adjusted by a period of an injection instruction pulse to adjust an injection amount of fuel. However, there are response delay times between a start of energization and opening of the valve and between an end of energization and closing of the valve; thus, the period of the injection instruction pulse is not necessarily equal to an actual injection period.

In addition, a valve element in the fuel injection valve does not move in a rectangular wave form like the instruction pulse but opens in accelerated motion, and when the valve is closed, the valve closes in accelerated motion. That is to say, the valve element moves in a quadratic curve shape with time.

Further, because the valve element cannot stop rapidly, the valve element collides with a component (valve seat or stopper) which defines a displacement of the valve element, thereby causing vibration (rebound) of the valve element. Due to this vibration, a relationship between a width (time) of the instruction pulse and the injection amount becomes non-linear instead of linear. Further, because the length of the period when this vibration continues depends also on accuracy of components constituting the fuel injection valve and other factors, individual variation of the fuel injection valve is a cause for the variation of the injection amount.

As described above, the response of the valve has instability due to the delay time and the vibration; thus, even when the width of the instruction pulse is made short, it is sometimes impossible to inject a sufficiently small injection amount of fuel. For this reason, there is a minimum value of the injection amount which the fuel injection valve can control, and this minimum value is referred to as a minimum injection amount.

In general, in order to make the minimum injection amount small, it is effective to increase spring force which biases the valve element in a valve closing direction so that the valve can be quickly closed after the instruction pulse ends.

However, in the case that a bias spring is set to provide a large load, when operating at a high fuel pressure, force acting in the valve closing direction increases, whereby it becomes difficult to open the valve. To address this issue, in a commonly-used fuel injection valve, the set load of the bias spring needs to be determined by trade-off between the minimum injection amount and an available fuel pressure.

As a conventional art addressing this issue, there is proposed an electromagnetic fuel injection valve which is configured such that a movable element driven by magnetic attractive force can move relative to a valve element which performs an opening/closing operation and such that a movable element is biased in the valve closing direction in a stationary state. In this electromagnetic fuel injection valve, in the stationary state, the movable element is in contact with a stopper provided on the valve element on an end face on a closed valve side; and an end face of the movable element on an open valve side is not in contact with the valve element but has a space therebetween. This space allows the movable element to free run without being in contact with the valve element when the fuel injection valve performs a valve opening operation, and after that, the end face of the movable element on the open valve side and the stopper of the valve element come into contact with each other to make the valve start to open (the valve element starts to move in the valve opening direction).

In a period of the above-described free-running of the movable element, the movable element is apart from the valve element; thus, the movable element can be accelerated without being influenced by a fuel pressure, whereby the valve opening operation can be easily performed even at a high fuel pressure.

As a result, the fuel injection valve having a structure in which the movable element can free run has an advantage that, even when the set load of the bias spring is made large, the valve opening operation can be easily formed at a high fuel pressure.

As the electromagnetic fuel injection valve described above, PTL 1 discloses an electromagnetic fuel injection valve in which the movable element is further divided into two pieces to be able to move relative to each other so that, also when the valve is closed, the movable element can free run, thereby accelerating the valve closing operation.

The electromagnetic fuel injection valve of PTL 1 is provided with the movable element which are made up of two pieces and loaded with a load by a first return spring and a valve closing body frictionally connected to the bigger one of the movable elements, and the first movable element part is loaded with a load in the closing direction by the first return spring, and the second movable element part is loaded with a load in the closing direction by a second return spring. As described above, by shortening not only the time necessary to open the valve but also the time necessary to close the valve, the minimum injection amount can be reduced.

CITATION LIST

Patent Literature

PTL 1: JP 4603749 B2

SUMMARY OF INVENTION

Technical Problem

When the movable element is configured to be able to free run, it is necessary to bias the movable element in the valve closing direction as disclosed in PTL 1.

In the case that the movable element is biased in the valve closing direction, there is a problem that, when the movable element collides with a magnetic core or a stopper at a predetermined open valve position, the motion of the bound becomes large because the force of the biasing spring acts in the direction to increase the bound.

When the bounding motion of the movable element becomes large, the variation of the injection amount becomes large as described above, and the characteristic of the injection amount becomes non-linear with respect the instruction pulse. As a result, the minimum injection amount cannot necessarily be small.

An object of the present invention is to configure a movable element used in a fuel injection valve to be able to free run and, at the same time, to control the bounding motion of the movable element when opening the valve.

Solution to Problem

In order to accomplish the above object, in an electromagnetic fuel injection valve of the present invention, a movable element is divided into a first movable element and a second movable element, and the first movable element and the second movable element both are configured to be movable in a valve closing direction relative to a valve element. The first movable element is biased in the valve closing direction by a first spring, and the second movable element is biased in a direction toward a magnetic core (valve opening direction) by a second spring. A biasing force of the first spring is larger than a biasing force of the second spring.

In a stationary state in a closed valve state, the biasing force in the valve closing direction by the first spring is transmitted to the second movable element and the valve element through the first movable element. With this arrangement, even when the second movable element is biased in the valve opening direction by the second spring, the second movable element is pushed back in the valve closing direction by the first spring and the first movable element, and a gap is created in an abutting part between the valve element and the second movable element in a relative displacement direction (axial direction); and this arrangement allows the second movable element to free run in an early stage of opening the valve while the second movable element is traveling in the gap created in the abutting part.

On the other hand, in the open valve state, the first movable element and the second movable element are displaced toward the magnetic core by magnetic attractive force, and the second movable element and the first movable element are apart from each other in the relative displacement direction. In other words, a gap is created in an abutting part between the second movable element and the first movable element in the relative displacement direction. This arrangement allows the first movable element to free run in an early stage of closing the valve while the first movable element is traveling in the gap created in the abutting part. The gap created in the abutting part between the second movable element and the first movable element prevents the biasing force in the valve closing direction by the first spring from being transmitted to the second movable element. As a result, at the time when the second movable element collides with a member (stopper) which controls the displacement in the valve opening direction, the biasing force in the valve closing direction by the first spring is released from the second movable element, and because the second movable element is biased in the valve opening direction by the second spring, bounding motion of the second movable element can be reduced.

Advantageous Effects of Invention

In the present invention, a time necessary to open/close the valve is reduced, and the bound of the movable element generated at the time of opening the valve is controlled, whereby a smaller minimum injection amount can be obtained.

DESCRIPTION OF EMBODIMENTS

Figure 1:
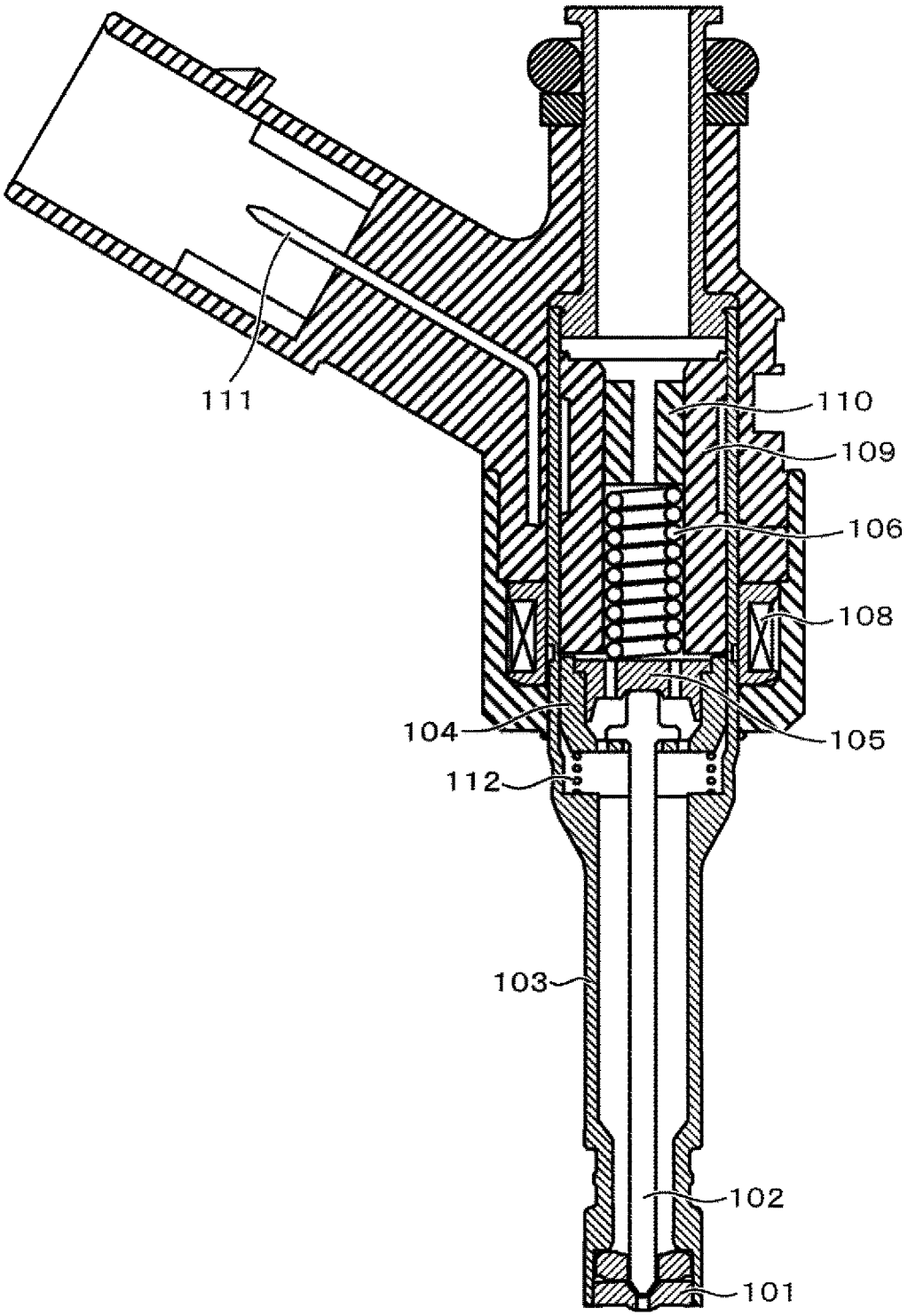
FIG. 1 is a sectional view showing a first embodiment of a fuel injection valve according to the present invention.

In the following, an embodiment of the present invention will be described. FIG. 1 is a sectional view of an example of an electromagnetic fuel injection valve according to the present invention. The electromagnetic fuel injection valve shown in FIG. 1 is an ON/OFF valve in which a valve element 102 moving up and down in an axial direction opens and closes a gap (fuel passage) between the valve element 102 and a valve seat 101, thereby controlling injection and stop of the fuel. When a coil 108 equipped in the electromagnetic fuel injection valve is not energized, the valve element 102 is biased in a direction toward the valve seat 101 by a bias spring (first spring) 106 provided in a magnetic core 109 through a movable member (first movable element) 105, and the gap between the valve element 102 and the valve seat 101 is closed.

Here, when the coil 108 is energized, magnetic flux is generated between the magnetic core 109 and the movable element (second movable element) 104 and between the magnetic core 109 and the movable member 105, and the movable element 104 and the movable member 105 are displaced in the direction toward the magnetic core 109, in other words, toward the upstream side from the fuel injection valve. When the movable element 104 displaced toward the upstream side, the valve element 102 comes into contact, in the relative displacement direction, with the movable element 104, and force is thus transmitted to the valve element 102, whereby the valve element 102 is also displaced toward the upstream side to open the valve.

On the other hand, the coil 108 is de-energized, the magnetic flux generated in the magnetic core 109 disappears, and the magnetic attractive force acting on the movable element 104 and the movable member 105 also decrease and finally disappear. As a result, when the force applied by the bias spring 106 to the movable member 105 becomes larger than the magnetic attractive force acting on the movable member 105 and the movable element 104, the movable member 105 and the movable element 104 are displaced toward the downstream side by the force of the bias spring 106 transmitted to the movable element 104 through the movable member 105, whereby the valve element 102 is closed.

The above description describes a basic operation of the electromagnetic fuel injection valve. The electromagnetic fuel injection valve is configured such that an energizing time of the coil 108 is controlled to control a period during which the valve element 102 is open, whereby a fuel injection amount is controlled.

Figure 2:
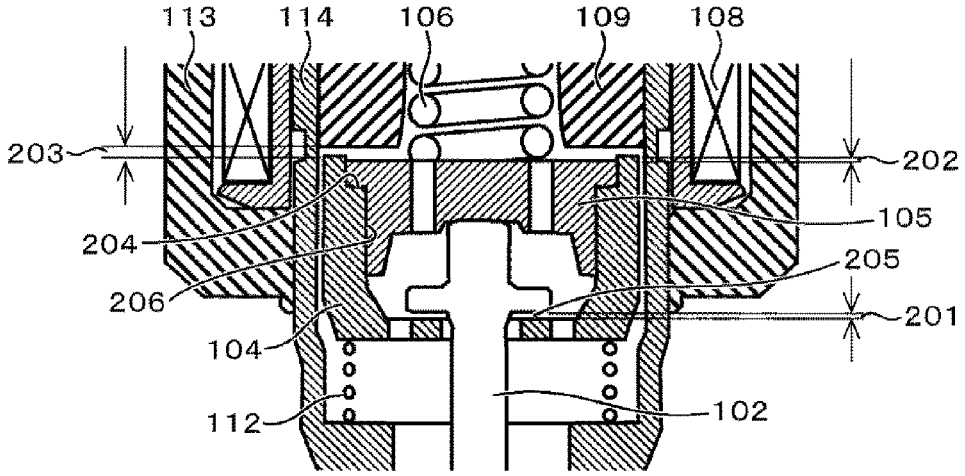
FIG. 2 is a sectional view of a fuel injection valve according to the present invention and shows an enlarged view of the vicinity of a movable element in a closed valve state.

FIG. 2 is an enlarged sectional view of a vicinity of the movable element 104 and the movable member 105 for describing an operation of opening/closing of the fuel injection valve related to an effect of the present invention.

Here, with reference to FIG. 2, there will be described a feature, an action, and an effect thereof of the valve opening operation and the valve closing operation according to the present invention.

In the electromagnetic fuel injection valve of the present embodiment, movable component, on which attractive force is acted by the magnetic flux generated in the magnetic core 109, includes two elements, the movable element 104 and the movable member 105. In other words, the movable element is made up of two movable elements the first movable element 105 and the second movable element 104) which can relatively move in the relative displacement direction with respect to the valve element. The movable member 105 is configured such that a downstream side surface of the movable member 105 and an upstream side surface of the movable element 104 can transmit force to each other on an abutting part 204 in the relative displacement direction. When the electromagnetic fuel injection valve is in a closed valve state, the movable member 105 is biased in the downstream direction by the bias spring 106, in addition, the movable element 104 is biased by an extra spring (second spring) 112, whose force is set smaller than a force of the bias spring 106, toward the magnetic core 109 on the upstream side, and force acts in the direction in which the movable member 105 and the movable element 104 get close to each other.

When the movable member 105 and the movable element 104 are in contact with each other on the abutting part 204 as described above, the end face of the movable member 105 on the side of the magnetic core 109 is located on the downstream side from the end face of the movable element 104 on the magnetic core 109 side, and there is a difference 202 between the end face positions.

In the closed valve state, the movable member 105 is in contact with the valve element 102 in the relative displacement direction, the force of the bias spring 106 acts on the valve element 102 through the movable member 105, thereby biasing the valve element 102 in the valve closing direction.

In the closed valve state as described above, there is a clearance (gap) 201 at the position of the abutting part 205 between the movable element 104 and the valve element 102. Between the movable element 104 and the magnetic core 109 is created a clearance (gap) 203, and the clearance 203 is set to be larger than the clearance 201.

When the coil 108 starts to be energized, magnetic flux flows between the magnetic core 109 and the movable element 104 and between the magnetic core 109 and the movable member 105; therefore, magnetic attractive forces act on the movable element 104 and the movable element 105. In this state, the magnetic flux flows through from a cylindrical side surface of the movable member 105 toward an inner circumferential surface 206 of the movable element 104; thus, even when the movable component receiving the magnetic attractive force is divided into two elements, a sufficient amount of magnetic attractive force can act on each element. The inner circumferential surface 206 of the movable element 104 forms a sliding part between the inner circumferential surface 206 and the cylindrical side surface of the movable element 105.

Further, there is provided a large clearance between the movable element 104 and a downstream side end face of the movable member 105, and the magnetic flux hardly flows through this clearance. As a result, this arrangement controls an effect that the movable element 104 and the movable member 105 attract each other in the axial direction of the valve element by magnetic attractive force.

When the magnetic attractive force acting on the movable element 104 and the movable member 105 becomes larger than the force of the bias spring 106, the movable element 104 and the movable member 105 start to move in one body in the direction toward the magnetic core 109. At this time, the direction of force of the extra spring 112 biasing the movable element 104 is in the direction toward the magnetic core 109, and the force of the extra spring 112 and the force of the bias spring 106 act to make the movable element 104 and the movable member 105 get close to each other, so that the movable element 104 and the movable member 105 do not get apart from each other. This arrangement allows the movable element 104 and the movable member 105 to start to move in one body in the direction toward the magnetic core 109.

At this time, because the motion of the movable element 104 and the movable member 105 is motion (free-running motion) which is performed while no fuel is flowing and is performed independently of the valve element 102 receiving force form the fuel pressure, the motion is not affected by the pressure of the fuel or other factors.

When the displacement of the movable element 104 reaches the size of the space 201, the movable element 104 comes into contact with the valve element 102 on the abutting part 205 and transmits force, thereby pulling up the valve element 102. At this time, the movable element 104 collides with the valve element 102 in a state of performing the free-running motion together with the movable member 105 and having kinetic energy, whereby the valve element 102 starts to impulsively move in the opening direction.

The fuel pressure is acting on the valve element 102, and the force due to this fuel pressure is large when the displacement of the valve element 102 is small and a pressure decrease due to Bernoulli's effect caused by a flow of the fuel at the end point of the valve element 102 is large. As described above, it is when the valve opening operation is hard to perform because of a large fuel pressure that valve element 102 is impulsively opened by the free-running motion; thus, even when a higher fuel pressure ing, the valve opening operation can be performed. Or, the bias spring 106 can be set to provide a larger force with respect to a necessary fuel pressure range in which the valve can operate. By setting the bias spring 106 to provide a larger force, it is possible to reduce a time required for a valve closing operation to be described later and is thus effective in controlling a small injection amount.

After the valve element 102 starts the valve opening operation, the movable element 104 collides with the magnetic core 109. At this moment, because the movable member 105 continues moving, the movable element 104 and the movable member 105 get apart from each other, and the force due to the bias spring 106 not transmitted to the movable element 104 anymore.

When the movable element 104 collides with the magnetic core 109, the movable element 104 rebounds; however, the movable element 104 is attracted to the magnetic core by the magnetic attractive force acting on the movable element 104 and finally stops. At this time, the extra spring 112 provides force on the movable element 104 in the direction toward the magnetic core 109, and the rebounding motion can thus be made small. The small rebounding motion shortens a period of time when the gap between the movable element 104 and the magnetic core 109 is large, and accordingly the operation can be stably performed for a smaller injection pulse width.

Figure 3:
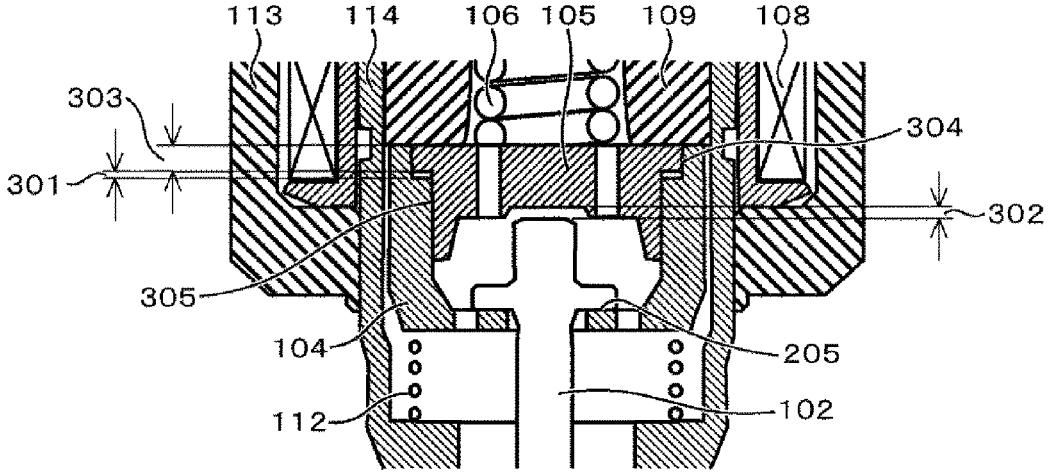
FIG. 3 is a sectional view of the fuel injection valve according to the present invention and shows an enlarged view of the vicinity of the movable element in an open valve state.

The movable element 104, the movable member 105, and the valve element 102 finish the valve opening operation in the above-described way and then stand still in an open valve state as shown in FIG. 3. In the open valve state, there is provided a gap between the valve element 102 and the valve seat 101, and the fuel is being injected. The fuel flows in the downstream direction through a central hole provided in the magnetic core 109, a fuel passage hole provided in the movable member 105, and a fuel passage hole provided in the movable element 104.

In the open valve state shown in FIG. 3, there is created a gap in the abutting part 204 between the movable element 104 and the movable member 105, and a clearance 301 is created. The size of the clearance 301 is equal to the difference 202 between the end positions.

Although the clearance 301 is created as described above, part of the magnetic flux passing through the movable member 105 can flow through an outer circumferential side surface 304 of the movable member 105; thus, a magnetic attractive force acting between the movable member 105 and the magnetic core 109 does not decrease. In order to obtain this effect, a height 303 of the outer circumferential side surface 304 is preferably set so that the area of the movable member 105 facing the magnetic core 109 minus the area of a circle made by a sliding side surface 305 of the movable member 105 is equivalent to the area of the outer circumferential side surface 304 or the area of the outer circumferential side surface 304 is larger. With this arrangement, a sufficient area of the outer circumferential side surface 304 is secured for the magnetic flux to flow through, whereby it is possible to control decrease in the magnetic flux due to the created clearance 301. In addition, by securing a sufficient area of the outer circumferential side surface 304, the magnetic attractive force generated on the surface of the clearance 301 is prevented from being too large, whereby it is possible to control an effect which prevents the movable member 105 and the movable element 104 from getting apart from each other in the relative displacement direction.

Further, when the vale is open, the movable member 105 and the valve element 102 are also apart from each other in the relative displacement direction, and a clearance 302 is created therebetween. A size of the clearance 302 is set to be larger than the clearance 301. In order to make the movable member 105 and the movable element 104 stand still being apart from each other, the area on the attractive surface side of the movable member 105 may be set so that the magnetic attractive force generated between the magnetic core 109 and the movable member 105 is a little larger than the force of the bias spring 106.

Here, because the force received by the valve element 102 from the fuel pressure is not transmitted to the movable member 105, the magnetic attractive force acting on the movable member 105 does not have to be set excessively large. An excessive magnetic attractive force sometimes delays the time period between the termination of energization and the start of the valve closing operation; however, the area on the attractive surface side of the movable member 105 can be set so that such delay time is minimized.

When the fuel injection valve is open in the described above, the open valve state is maintained, in a balance that the magnetic attractive force acting on the movable element 104 supports the force due to the fuel pressure acting on the valve element 102 and that the magnetic attractive force acting on the movable member 105 supports the force of the bias spring 106.

Note that a lift amount of the valve element 102 from the valve seat 101 is equal to a height which is the clearance 203 between the movable element 104 and the magnetic core 109 in the closed valve state minus the clearance 201 in the abutting part 205 between the movable element 104 and the valve element 102 in the closed valve state.

Next, a valve closing operation of the fuel injection valve according to the present invention will be described.

When the energization of the coil 108 is terminated while the valve is open, the magnetic flux generated in the magnetic core 109 decreases, and the magnetic attractive force acting on the movable element 104 and the movable member 105 accordingly decreases.

When the magnetic attractive force acting on the movable member 105 becomes smaller than the force of the bias spring 106 biasing the movable member 105, the movable member 105 starts to move in the valve closing direction.

Here, a timing when the movable member 105 starts to move in the valve closing direction is hardly affected by the fuel pressure. The force of the fuel pressure attracts, by way of the valve element 102, the movable element 104 in the valve closing direction; however, this force is not transmitted to the movable member 105, whereby the movable member 105 can start to move at an intended and designed timing without depending on the fuel pressure.

When the fuel pressure is low, the force of the fuel pressure acting on the movable element 104 in the valve closing direction is small; thus, the movable element 104 hardly starts the valve closing operation. This phenomenon is the same as in the commonly-used fuel injection valve (with a single movable element), and the phenomenon is one of the causes for the valve to take a longer time to be closed particularly when the fuel pressure is not high.

In the configuration of the present embodiment, the movable element 104 and the movable member 105 are separated to be able to move relative to each other, and the movable member 105 does not support the force of the fuel pressure; thus, even in such difficult conditions of the fuel pressure that the movable element 104 cannot close the valve, the movable member 105 can first start to move to the Valve closing direction.

Figure 5:
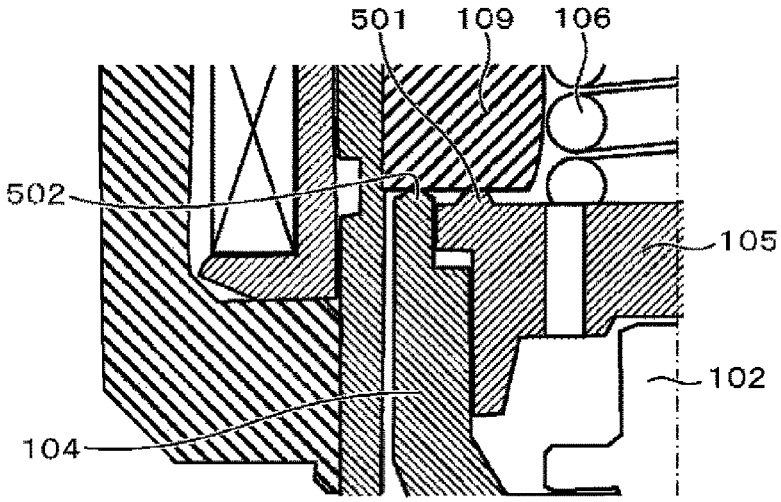
FIG. 5 shows an enlarged view of the vicinity of the movable element in the open valve state.

Here, particularly in order to speed up the start of the movable member 105 toward the valve closing direction, there is preferably provided a protrusion 501, as shown in FIG. 5, on a part on which the movable member 105 and the magnetic core 109 come into contact with each other, and a height of the protrusion is preferably made higher than a protrusion 502 provided on a contact part on which the movable element 104 and the magnetic core 109 come into contact with each other. By providing the protrusion 501 on the movable member 105 as described above, the magnetic attractive force decreases in a shorter time, and it is possible to reduce the force generated by squeeze effect due to fuel in the gap between the movable member 105 and the magnetic core 109, and as a result the motion of the movable member 105 in the valve closing direction can be speeded up. If one or both of such protrusions are provided, on the side of the magnetic core 109, it also provides the same effect. (Note that, the case that the protrusion 501 and the protrusion 502 are provided as described above, the end faces of the movable element 104 and the movable member 105 on the magnetic core 109 side are defined as the surfaces on the parts on which the protrusion 501 and the protrusion 502 are in contact with the magnetic core 109.)

The way in which a protrusion is provided on the end face of a movable element in this manner is commonly used in fuel injection valves. Generally, the height of the protrusion is selected from trade-off relationships between responsiveness of the movable element and the obtained magnetic attractive force however, according to the present invention, because the movable element is divided into the movable element 104 and the movable member 105, the movable element 104 can be made mainly to receive a large magnetic attractive force, and the movable member 105 can be made mainly to receive a high responsiveness. As a way to set in this manner, there is a way in which a height of the protrusion 502 provided on the movable element 104 is higher than a height of the protrusion 501 provided on the movable member 105. Alternatively, the same effect can also be obtained when only the protrusion 501 is provided, on the movable member 105 and no protrusion is provided on the movable element 104.

The movable member 105 collides, after moving in the valve closing direction, with the abutting part 204 of the movable element 104 and displaces the movable element 104 in the valve closing direction. Before colliding with the movable element 104, the movable member 105 performs free-running motion by the force of the bias spring 106. Note that because the clearance 302 between the valve element 102 and the movable member 105 is set larger than the clearance 301 created between the movable element 104 and the movable member 105, the movable member 105 comes into contact with the movable element 104 before coming into contact with the valve element 102.

The movable element 104 is attracted, before being hit by the movable member 105, by the magnetic flux remaining in the magnetic core 109 in the valve opening direction, and in addition, because the gap between the magnetic core 109 and the movable element 104 is small, the movable element 104 hardly moves in the Valve closing direction due to squeeze effect.

In the configuration of the present embodiment, because the movable member 105 free runs and then collides with the movable element 104 which is difficult to be displaced in the valve closing direction, the movable element 104 can quickly start the valve closing operation. Further, the force acting on the movable element 104 due to squeeze effect and the magnitude of the magnetic attractive force have the property that they rapidly decrease as the distance between the movable element 104 and the magnetic core 109 increases. For this reason, after the collision of the movable member 105 against the movable element 104 impulsively makes the movable element. 104 apart from the magnetic core 109, the movable element 104 can quickly move in the valve closing direction.

When the movable element 104 starts motion in the valve closing direction operation, the valve element 102, which is attracted in the valve closing direction by fuel pressure, also starts the valve closing operation.

When the valve element 102 finally comes into contact with the valve seat 101, the movable element 104 and the valve element 102 get apart from each other, creating the gap in the abutting part 204, and then the movable element 104 moves independently of the valve element 102. By releasing the valve element 102 from the movable element 104 in this way at the moment of closing the valve, the bounding motion caused by the collision of the valve element 102 against the valve seat 101 can be reduced. This effect of controlling the bound is obtained by releasing the movable element 104 from the valve element 102 at the moment when the valve element 102 collides with the valve seat 101 and thus preventing a kinetic energy of the movable element 104 from being converted into a bounding energy.

Note that the magnitude of the force generated by the bias spring 106 can be adjusted so that the timing between the operation of the valve element 102 and the operation of the movable member 105 at the time of closing the valve is different depending on the fuel pressure.

When the force of the bias spring 106 is small enough, the valve element 102 first collides with the valve seat 101, and the movable member 105 and the valve element 102 then come into contact with each other to get into the closed valve state. In this case, the valve element 102 and the movable member 105 always come into contact with each other after the valve, element 102 and the valve seat 101 come into contact with each other, and the chronological order of these events does not depend on the fuel pressure.

On the other hands, in the case that the bias spring 106 is set to have a large force, when the fuel pressure is low, the movable member 105 collides with the valve element 102 before the valve element 102 comes into contact with the valve seat 101. When the fuel pressure is low, the force is not large enough to close the valve element 102, and it tends to take a long time to close the valve; however, if the movable member 105 collides with the valve element 102 to close the valve as described above, the time necessary to close the valve can be shortened.

In order to make the valve element 102 and the movable member 105 come into contact with each other before the valve element 102 comes into contact with the valve seat 101, the bias spring 106 may be set to generate a load larger than the force by which the valve element 102 is attracted toward the downstream side by the fuel pressure.

An operation, in which the valve element 102 and the movable member 105 are set to operate at different timings, depending on the fuel pressure as described above, is effective from the point of view of preventing the valve seat 101 and the valve element 102 from becoming worn. At low fuel pressures, the valve element 102 collides with the valve seat 101 after being accelerated by the movable member 105; however, at high fuel pressures, before colliding with the movable member 105, the valve element 102 is accelerated by the fuel pressure and collides with the valve seat 101. At high fuel pressures, the collision power between the valve element 102 and the valve seat 101 is large, whereby the both can be worn. In particular, at the moment of the collision between the valve element 102 and the valve seat 101, a part of the end point of the valve element 102 comes into contact with a part of the valve seat 101, whereby the stress tends to be large. If the valve element 102 is made to collide with the valve seat 101 before the movable member 105 collides with the valve element 102, the valve seat 101 and the valve seat 102 collide with each other while the force of the bias spring 106 is not acting on the valve element 102, whereby the collision power can be small, thereby providing an advantageous effect to prevent the wearing. In this case, the movable member 105 collides with the valve element 102 after the valve element 101 and the valve seat 102 collide with each other, and at this moment the whole circumference of the end point of the valve element 101 is already in contact with the valve seat 102; thus, friction due to excessive stress does not occur.

Figure 4:
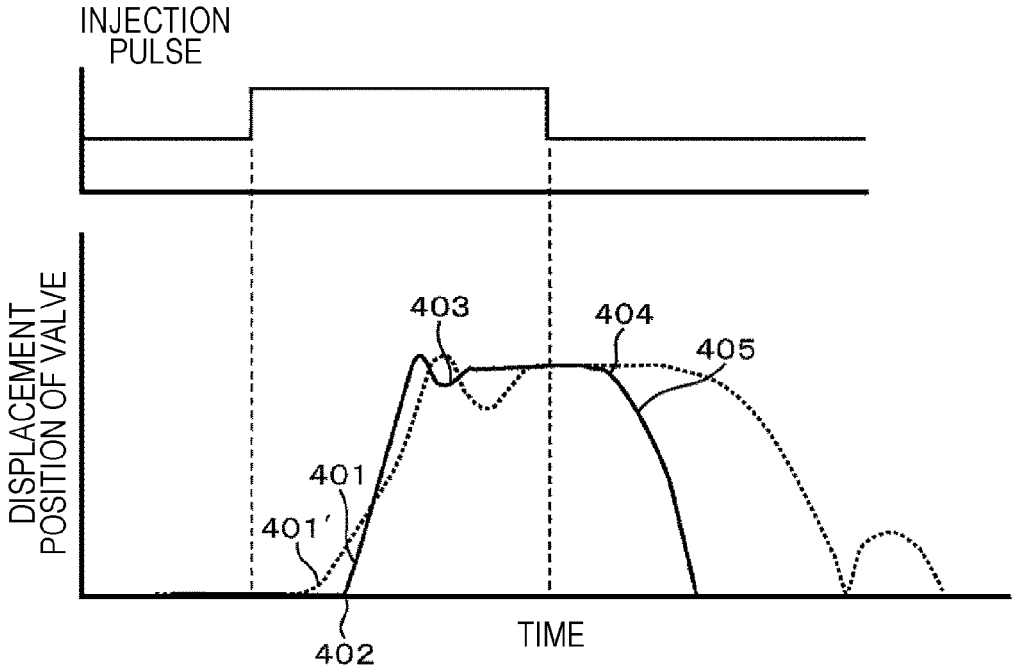
FIG. 4 is a schematic diagram showing a valve operation of the fuel injection valve according to the present invention.

FIG. 4 schematically shows the motion of the valve element 102 (valve behavior) realized by the above operation. The solid line represents the behavior of the present embodiment, and the broken line represents a valve behavior of a commonly-used the fuel injection valve.

In the present embodiment, the behavior 401 of the valve element 102 at the beginning of opening becomes steep due to the free-running motion of the movable element 104, and this advantageous effect can reduce the time period when the valve element is in a state 401' in which the displacement is small. This advantageous effect makes it possible to prevent a large liquid droplet caused by the fuel flowing out at a low speed. The valve timing 402 at the beginning of opening the valve is not affected by the fuel pressure.

Further, after the valve element 102 reaches a predetermined lift position and opens the valve, it is possible to make the bounding behavior 403, after the movable element 104 collides with the magnetic core 109, smaller than that of a commonly-used fuel injection valve.

The timing 404 at which the valve element 102 gets into the valve closing operation can be speeded up by the collision of the movable member 105 against the movable element 104. Further, because the valve closing operation 405 is started when the movable member 105 collides with the movable element 104 after free running, the speed of the valve closing operation performed by the valve element 102 is high, whereby the time necessary for the valve closing operation can be shortened.

As described above, the delay times are short with respect to the injection pulse, and a stable operation is possible; thus it is possible to stably perform the operation having a short injection period with a short injection pulse, whereby a small minimum injection amount can be realized.

REFERENCE SIGNS LIST

101 valve seat
102 valve element
103 vessel
104 movable element
105 movable member
106 bias spring
108 coil
109 magnetic core
110 spring adjuster
111 terminal
201 space
202 difference between end face positions
203 space
204 abutting surface
205 abutting surface
301 space
302 space
303 side surface height
304 outer circumferential side surface
305 sliding side surface
401 start of valve opening
402 start-of-valve-opening timing
403 bounding motion
404 start of valve closing
405 valve closing operation

The invention claimed is:

1. An electromagnetic fuel injection valve comprising:

a valve element which opens and closes a gap between the valve element and a valve seat;

a movable element which transmits force to the valve element to cause the valve element to operate;

a magnetic core which causes a magnetic flux to flow between the magnetic core and the movable element to generate a magnetic attractive force; and a coil configured to generate a magnetic flux in the magnetic core, wherein an electricity supplied to the coil is controlled to cause the valve element to open and close a fuel passage, the movable element is configured with a first movable element and a second movable element, each of the first movable element and the second movable element has a magnetic attractive surface facing the magnetic core, the first movable element is biased by a first spring in a valve closing direction, the second movable element is biased in a valve opening direction by a second spring which has a biasing force smaller than a biasing force of the first spring, the first movable element and the second movable element are movable relative to the valve element, the valve element is configured to be biased by the second movable element in the valve opening direction, an abutting part is provided between the first movable element and the second movable element, on which the abutting part the first movable element and the second movable element are apart from each other with a clearance in a relative displacement direction in a valve-opened state, and from a valve-opened state to the valve-closed state, the first movable element moves to abut against the second movable element, and the valve element is configured to start moving in the valve closing direction after abutment of the abutting part.

2. The electromagnetic fuel injection valve according to claim 1, wherein in a closed valve state, the first movable element is in contact with the valve element to transmit the biasing force of the first spring to the valve element.

3. The electromagnetic fuel injection valve according to claim 1, wherein a clearance created between an magnetic attractive surface of the first movable element and the magnetic core in the closed valve state is larger than a clearance created between a magnetic attractive surface of the second movable element and the magnetic core in the closed valve state.

4. The electromagnetic fuel injection valve according to claim 1, wherein a bottom surface of the magnetic core faces both the first movable element and the second movable element.

5. The electromagnetic fuel injection valve according to claim 4, wherein when the valve element is in a closed state, a gap is formed at a position of a second abutting part that is provided between the second movable element and the valve element.

6. The electromagnetic fuel injection valve according to claim 4, wherein when the valve element is in an open state, a gap is formed at a position of a third abutting part that is provided between the first movable element and the valve element.

7. The electromagnetic fuel injection valve according to claim 5, wherein when the valve element is in an open state, a gap is formed at a position of a third abutting part that is provided between the first movable element and the valve element.

8. The electromagnetic fuel injection valve according to claim 4, wherein the first movable element is inside the second movable element.

9. The electromagnetic fuel injection valve according to claim 1, wherein the first movable element includes a side surface radially facing the second movable element in a portion closer to the magnetic core than to the abutting part, and an area of the side surface of the first movable element is larger than an area of the magnetic attractive surface of the second movable element.

10. The electromagnetic fuel injection valve according to claim 1, wherein a protrusion is provided between the magnetic attractive surface of the first movable element and the magnetic core.

11. The electromagnetic fuel injection valve according to claim 1, wherein an outer diameter of the magnetic attractive surface of the first movable element is smaller than an outer diameter of the magnetic attractive surface of the second movable element.

12. An electromagnetic fuel injection valve comprising:

a valve element which opens and closes a gap between the valve element and a valve seat;

a movable element which transmits force to the valve element to cause the valve element to operate;

a magnetic core which causes a magnetic flux to flow between the magnetic core and the movable element to generate a magnetic attractive force; and a coil configured to generate a magnetic flux in the magnetic core, wherein an electricity supplied to the coil is controlled to cause the valve element to open and close a fuel passage, the movable element is configured with a first movable element and a second movable element, each of the first movable element and the second movable element has a magnetic attractive surface facing the magnetic core, the first movable element is biased by a first spring in a valve closing direction, the second movable element is biased in a valve opening direction by a second spring which has a biasing force smaller than a biasing force of the first spring, the first movable element and the second movable element are movable relative to the valve element, the valve element is configured to be biased by the second movable element in the valve opening direction an abutting part is provided between the first movable element and the second movable element, on which the abutting part the first movable element and the second movable element are in contact with each other in a relative displacement direction in a valve-closed state, and from a valve-opened state to the valve-closed state, the first movable element is configured to abut against the valve element after abutting against the second movable element.

13. An electromagnetic fuel injection valve comprising:

a valve element which opens and closes a gap between the valve element and a valve seat;

a movable element which transmits force to the valve element to cause the valve element to operate;

a magnetic core which causes a magnetic flux to flow between the magnetic core and the movable element to generate a magnetic attractive force; and a coil configured to generate a magnetic flux in the magnetic core, wherein an electricity supplied to the coil is controlled to cause the valve element to open and close a fuel passage, the movable element is configured with a first movable element and a second movable element, each of the first movable element and the second movable element has a magnetic attractive surface facing the magnetic core, the first movable element is biased by a first spring in a valve closing direction, the second movable element is biased in a valve opening direction by a second spring which has a biasing force smaller than a biasing force of the first spring, the first movable element and the second movable element are movable relative to the valve element, the valve element is configured to be biased by the second movable element in the valve opening direction an abutting part is provided between the first movable element and the second movable element, on which the abutting part the first movable element and the second movable element are in contact with each other in a relative displacement direction in a valve-closed state, and from a valve-opened state to the valve-closed state, the first movable element is configured to start moving in the valve closing direction earlier than a movement of the second movable element in the valve closing direction.

* * * * *